United States Patent [19]

Kovach

[11] 4,437,981

[45] Mar. 20, 1984

[54] IMMOBILIZATION AND NEUTRALIZATION OF CONTAMINANTS IN CRUDE OIL

[75] Inventor: Stephen M. Kovach, Ashland, Ky.

[73] Assignee: Ashland Oil, Inc., Ashland, Ky.

[21] Appl. No.: 443,413

[22] Filed: Nov. 22, 1982

[51] Int. Cl.[3] ..... C10G 29/04; C10G 29/06

[52] U.S. Cl. ..... 208/253; 208/251 R; 208/295; 208/297

[58] Field of Search ..... 208/253, 295, 297, 91, 208/251 R

[56] References Cited

U.S. PATENT DOCUMENTS

| | | | |
|---|---|---|---|
| 655,500 | 8/1900 | Macalpine | 208/295 |
| 1,643,272 | 9/1927 | Hellthaler | 208/295 |
| 2,446,040 | 7/1948 | Blair, Jr. | 208/251 R |
| 2,728,714 | 12/1955 | Winkler et al. | 208/251 R |
| 2,730,487 | 1/1956 | Porter et al. | 208/253 |
| 2,825,678 | 3/1958 | Jahnig et al. | 208/251 R |
| 2,901,419 | 8/1959 | Brill | 208/119 |
| 3,140,249 | 7/1964 | Plank et al. | 208/120 |
| 3,322,664 | 5/1967 | Paterson et al. | 208/251 R |
| 3,329,480 | 7/1967 | Young | 23/111 |
| 3,329,481 | 7/1967 | Young | 23/111 |
| 3,471,410 | 10/1969 | Oleck et al. | 252/454 |
| 3,553,104 | 1/1971 | Stover et al. | 208/120 |
| 3,556,988 | 1/1971 | Stover et al. | 208/120 |
| 3,717,587 | 2/1973 | Hepner | 252/455 Z |
| 3,772,185 | 11/1973 | Chang et al. | 208/253 |
| 3,798,153 | 3/1974 | Arndt, Jr. et al. | 208/251 R |
| 3,867,307 | 2/1975 | Scherzer et al. | 252/455 X |
| 3,977,963 | 8/1976 | Readal et al. | 208/120 |
| 4,022,714 | 5/1977 | Elliott, Jr. | 252/455 Z |
| 4,083,807 | 4/1978 | McKinney et al. | 252/455 Z |
| 4,188,501 | 2/1980 | Rycheck et al. | 208/295 |

*Primary Examiner*—Delbert E. Gantz
*Assistant Examiner*—Lance Johnson
*Attorney, Agent, or Firm*—Richard C. Willson, Jr; Carl D. Farnsworth

[57] ABSTRACT

The invention is concerned with substantially eliminating the deactivating effects of alkaline materials and metal contaminants and compounds thereof existing in crude oils by first desalting the crude oil and thereafter adding a select neutralizing and immobilizing metal component or compound thereof to said desalted crude oil prior to and/or during distillation thereof to obtain select fractions subsequently catalytically processed as by catalytic cracking with a crystalline zeolite containing catalyst.

13 Claims, 1 Drawing Figure

IMMOBILIZATION AND NEUTRALIZATION OF CONTAMINANTS IN CRUDE OIL

This invention is concerned with substantially limiting the catalytic deactivating effects of alkaline materials and metal contaminants existing in crude oils. In a more particularly aspect, the present invention is concerned with voiding the deactivating effects of sodium, magnesium, calcium and potassium present in crude oils as chlorides, carbonates and sulfates. In another aspect, the present invention is concerned with reducing the catalytic deactivating effects of metal contaminants of vanadium, nickel, iron and copper.

BACKGROUND OF THE INVENTION

Without exception, crude oils are discovered and recovered from porous rock formations beneath the earths surface. In this underground environment, the crude oil is in contact with salt water and alkaline contributing formations. The crude oil is recovered in the presence of water which leaches the more common alkaline metal salts such as sodium, magnesium, calcium and potassium present as the chloride, carbonate and sulfate. The crude oil is separated from water leaving behind emulsions comprising alkaline metal salts in the crude oil. A part of the crude oil refining process is known as desalting wherein washing with caustic and water neutralizes acidic components and salts are removed along with phenolic and naphthenic acids. The severity of this desalting operation varies the residual amount of the salts remaining in the crude oil as well as the amount of caustic and water wash used during the desalting operation. Following the desalting operation, the crude oil is normally separated in one of a sequence of steps comprising atmosphere and vacuum distillation with or without a preflash zone to separate the crude oil into a gaseous phase, naphtha, kerosene, light and heavy atmospheric gas oils and a residual fraction having an initial boiling point within the range of about 332° C. (630° F.) up to about 371° C. (700° F.). This residual portion of the crude oil comprising substantial material boiling above about 538° C. (1000° F.) is referred to in the industry as a topped crude, a reduced crude or simply a residual oil. This residual fraction normally comprises highest concentration of residual alkaline material not removed in the desalting operation and contributed in part by the caustic and water wash above discussed. In addition, there is present, depending on crude source, substantial levels of metal contaminants comprising vanadium, nickel, iron and copper contained as metallo-organic compounds such as porphyrins, asphaltenes, multi-ring cyclic compounds, and aliphatic organo acidic metal salts.

Contaminant metals of nickel and iron are known to contribute to gas make and coke make during cracking operations in the presence of relatively high concentrations of these metals. On the other hand, vanadium has been found to adversely affect a zeolite cracking catalyst activity when allowed to exist as a low melting point material which will flow at the temperature conditions encountered during catalyst regeneration and hydrocarbon cracking operations. The flow of such a vanadium compound causes pore plugging, catalyst particle agglomeration leading to defluidization thereof and, more importantly, causes an irreversible destruction of the zeolite crystalline structure employed in the catalyst composition. In addition, residual alkaline material also contacts acid cracking sites in a catalyst matrix thereby destroying its activity as well as destroying the zeolite pore structure and its active cracking sites.

The present invention particularly addresses the concept of voiding the deactivating effects of metal contaminants and alkaline material in a residual oil fraction prior to subjecting the feed to catalytic cracking in the presence of a crystalline zeolite containing cracking catalyst. The prior art refers to a crystalline zeolite material as a crystalline aluminosilicate which has a particular crystalline structure depending on the type of crystalline zeolite employed.

SUMMARY OF THE INVENTION

The present invention is concerned with the method and means for achieving immobilization and neutralization particularly of alkaline material and metal contaminants found in crude oils and residual portions thereof. In a more particular aspect, the invention is concerned with the addition of a select additive material comprising a metal or compound thereof selected from the group consisting of titanium, zirconium, manganese, lanthanum, and indium. The select additive material may be in the form of an organic or inorganic compound species which is added to the crude oil as herein provided to effect desired immobilization and neutralization of contaminant materials.

The concept of the present invention is particularly concerned with the addition of the select additive material herein identified to the crude oil or a residual fraction thereof in advance of primary distillation thereof or during said distillation operation to achieve desired reaction with the metal contaminants in the crude oil feed. The additive material selected is one which will react with metal contaminants including alkaline metals. The contaminant materials include vanadium, nickel, copper, iron, sodium, potassium, magnesium and calcium in various concentrations in the crude oil depending on crude oil source. According to the invention, a compound or complex of the metal additive is formed with one or more alkaline materials and contaminant metal components. In addition, the select metal additive is selected from one or more metal additive materials which will particularly react with active species of residual alkaline salts as well as vanadium to form, for example, vanadium titanate whereby immobilization of vanadium is particularly instituted early whereby separation and recovery thereof during distillation of the crude oil may occur before being upgraded as by catalytic conversion of various fractions thereof by techniques known in the petroleum refining industry. The concentration of the metal additive selected to immobilize and neutralize undesired constituents above identified will vary with different crude oils but generally will be selected from within the range of 0.01 up to about 2 wt% of the crude. The amount of additive metal component added will be at least in a 1 to 2 ratio by weight of additive metal to contaminant metal. In a specific embodiment, one part titanium by weight is added for two parts of contaminant metal (Na, Mg, Ca, K, V, Ni, Cu and Fe) by weight. This ratio may also be increased from a 1/1 ratio up to about a 5/1 ratio of titanium to one part of a contaminant metal.

In a particular embodiment, the additive metal is added according to this invention after caustic and water washing of the crude oil; during or prior to fractionation of the crude oil to form high melting point solids along with neutralization of alkaline metal components. In another embodiment the additive metal may be added to the crude atmospheric distillation tower operation itself, to the tower bottoms with oil feed or to the reboiler section of the crude distillation tower.

BRIEF DESCRIPTION OF THE DRAWING

The drawing is a diagrammatic sketch in elevation of one arrangement of distillation steps for processing crude oil to obtain select fractions thereof for further upgrading in a petroleum refining operation.

TABLE 1

Discussion of the Specific Embodiments

Figure 1:
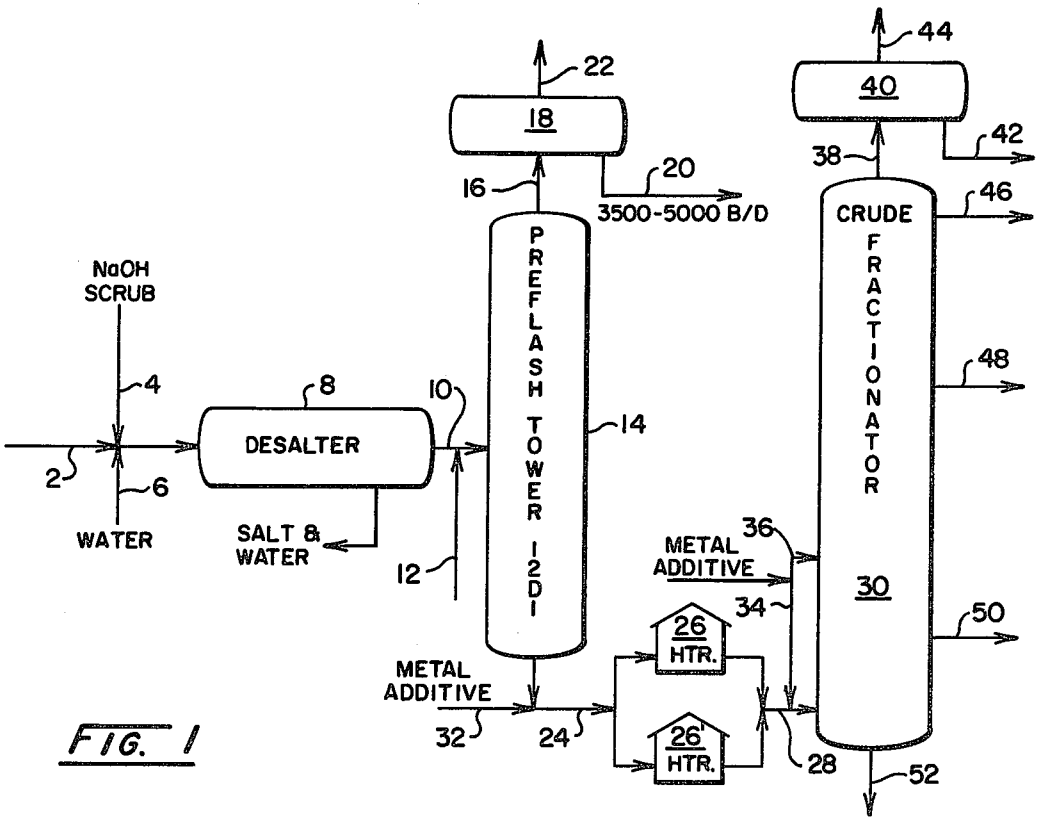

| Oil or Crude | API Grav 650+(2) Total | Volume % of 650+ Fraction Boiling at 650-1025 | 1025+ | Ramsbottom Carbon Content 650-1025 | 650+ Total | Wt. ppm Metals(3) Ni | V | Fe | Ni Equiv. | Wt. % S in 650+ Total | Weight of Nitrogen (ppm) 650+ Fraction Total | Basic | Wt. ppm Na |
|---|---|---|---|---|---|---|---|---|---|---|---|---|---|
| VGO | 28.4 | 100 | 0.0 | 0.38 | 0.38 | 0.2 | 0.1 | 2.6 | .059 | .83 | 722 | 260 | 0.8 |
| Mexican Isthmus | 16.9 (21.3) | 65.3 | 34.7 | 0.49 | 4.96 | 2.5+ | 33.8 | 1.9 | 9.81 | 2.75 | 950 | 450 | 6.9 |
| Mexican Kurkuk(1) | 17.4 | | | | 9.30 | 35.0 | 99.0 | 17.0 | 58.02 | 2.94 | 2100 | 723 | 1.8 |
| Murban | 23.1 | 78.7 | 21.3 | 0.49 | 3.99 | 3.0+ | 1.5 | 11.9 | 4.99 | 1.64 | 512 | 200 | 7.5 |
| Arabian Light | 19.1 | 64.7 | 35.3 | 0.47 | 6.56 | 6.4 | 24.7 | 3.2 | 12.00 | 2.39 | 940 | 507 | 9.2 |
| Arabian Med. | 14.5 | 51.8 | 48.2 | 0.46 | 9.00 | 19.6 | 63.0 | 2.9 | 33.13 | 4.43 | | | |
| Ekofish | 22.7 | 72.8 | 27.2 | 0.36 | 4.42 | 1.4 | 3.0 | 2.4 | 2.36 | 0.38 | | | |
| Fostenton | 10.9 | 43.6 | 56.4 | 0.42 | 16.81 | 48.8 | 119.0 | 3.1 | 74.03 | 4.22 | | | |
| Iranian Light | 17.4 | 60.8 | 39.2 | 0.48 | 9.01 | 21.9 | 60.0 | 3.1 | 34.84 | 2.50(4) | | | |
| La./Miss Sweet | 23.7 | 80.2 | 19.8 | 0.33 | 4.36 | 2.7+ | — | 8.5 | 3.90 | 0.26 | | | |
| Wyoming Sour | 12.4 | 40.7 | 59.3 | 0.32 | 15.1 | 0.6 | 70.0 | 2.0 | 15.47 | 3.84 | | | |

(1)A refinery blend of Mexican and Kirkuk crudes.
(2)Throughout the table 650 and 1025 refer to 343.3° C. (650° F.) and 551.6° C. (1025° F.) respectively; 650+ refers to 650° F. + material as defined below.
(3)Copper level was below 0.5%, except that Mexican Kirkuk contained 0.6%; all metals expressed as metal in ppm, based on the weight of the 650+ fraction.
(4)Calculated.

Referring now to the drawing by way of example, a raw crude oil of a composition identified in Table 1 above is charged to the process by conduit 2. The charged crude oil is mixed with sodium hydroxide or caustic in conduit 4, and water charged by conduit 6 is heated to a temperature of 66° C. (150° F.) to 177° C. (350° F.) and passed to a desalter 8 for effecting separation settling and removal of hydrogen sulfide, phenolic compounds, and naphthenic acids. The sodium hydroxide-water wash step is normally accomplished in a sequence of a combination of steps so that the water wash effectively removes substantial inorganic salts originally present in the feed, sodium hydroxide and the sodium salts of organic acidic compounds formed during desalting. The desalting step is desirably arranged to maximize the removal of the bulk of the alkaline salts but is not necessarily quantitative in operation.

In one specific embodiment of this invention a select immobilizing-neutralizing metal additive material above identified and comprising one or more of Ti, Zt, Mn, La and In is added to the desalted crude oil in conduit 10 by conduit 12 and prior to the desalted crude oil entering an atmospheric preflash zone 14. The desalted crude oil with one or more of the identified select additive materials is sent in one specific embodiment to the preflash separation zone 14 employed to effect a preliminary removal of light naphtha and lower boiling material from the crude oil removed from a preflash zone 14 by conduit 16 for passage to knock out drum 18 wherein the temperature and pressure conditions are maintained to effect separation of light naphtha from lower boiling gaseous materials. The condensed naphtha is withdrawn by conduit 20 with gaseous material being recovered by conduit 22.

Materials higher boiling than light naphtha in the crude oil charge is withdrawn from the bottom of preflash zone 14 by conduit 24, passed to one or more heater zones 26 and 26, and thence is passed by conduit 28 to the crude atmospheric distillation zone 30.

It is contemplated within the scope of the operating concept of this invention to add the select immobilizing additive material to one or a combination of addition points in the crude processing sequence. That is, the metal additive may be added separately or in addition to other points of identified addition points as by either conduit 32 to conduit 24, conduit 34 to conduit 28 or directly to tower or fractionation zone 30.

The addition of the select immobilization-neutralization metal additive herein identified as above provided causes reaction to occur between residual alkaline metals and metal contaminants in the crude oil charge recovered from desalting. The metal components of vanadium, nickel, iron and copper and compounds thereof and particularly vanadium are immobilized as herein provided. The reaction of sodium hydroxide with titania yields sodium titanate, a high melting solid 982° C. (>1800° F.) which melting point is above the normally encountered in a catalytic conversion operation. Reactions of titania with vanadium, iron, nickel and copper will also yield the corresponding titanates which materials are also high melting point solids. Thus, by promoting and accomplishing the metal combinations above identified, the metal contaminants normally accompanying a crude oil are effectively immobilized and alkaline material is effectively neutralized before the contaminants come in direct contact with downstream processing catalysts and particularly a fluid zeolite containing cracking catalysts. The deactivating effect of low temperature flowing vanadium is voided by changing it to a higher melting point material above identified which may or may not be partially separated and removed during crude distillation.

In fractionation zone 30, atmospheric separation of the charged preflashed crude oil is effected under conditions to recover material boiling below heavy naphtha which material is withdrawn from the top of the tower by conduit 38 for passage to a knock out drum 40 wherein a separation between gaseous components and light naphtha is made. Separated naphtha is recovered by conduit 42 with gaseous material being recovered by conduit 44. In tower-fractionator 30 a temperature of distillation spread is selected to recover heavy naphtha as by conduit 46, kerosene by conduit 48, a light gas oil or middle distillate by conduit 50. The tower bottoms may be temperature controlled within the range of 332° C. (630° F.) to about 371° C. (700° F.) for recovery of gas oil and higher boiling range material referred to as a residual oil, topped or reduced crude which is withdrawn by conduit 52 for further separation or processing as desired. In some prior art processes, a further separation of the residual fraction is accomplished by vacuum distillation to recover light and heavy vacuum gas oils from vacuum resid, whereby atmospheric and vacuum gas oils are combined and processed as by catalytic conversion. On the other hand, the total topped crude oil or residual portion thereof withdrawn by conduit 52 may be processed in a reduced crude catalytic cracking operation.

In crude oil processing operations of the prior art, the residual oil fraction recovered from the atmospheric tower bottoms and boiling in excess of about 332° to 343° C. (630° to 650° F.) is known to contain varying concentrations of sodium, magnesium, calcium and potassium introduced in part by using aqueous solutions of sodium hydroxide comprising calcium and magnesium. In addition, the residual oil comprises vanadium, nickel, iron and copper metal contaminants which are contained therein is free metals, oxides and metallo-organic materials such as porphyrins, asphaltenes, multi-ring cyclic compounds, and aliphatic organo-acidic metal salts. The conversion processing of residual oils or reduced crudes with such contaminants with a fluid cracking catalyst is known to deposit metal contaminants on the catalyst whereby rapid deactivation of the catalyst occurs. The alkali metals neutralize the catalyst and working cracking sites in the matrix and the crystalline zeolite component of the catalyst. Nickel and iron deposited on the catalyst are known to cause unfavorable side reactions particularly associated with dehydrogenation or gas formation and coking. Methyl clipping is also said to occur during catalytic cracking which effects catalyst activity and selectivity.

In copending applications U.S. Ser. Nos. 06/277,752 and 06/277,751 it has been recognized that vanadia has a particularly adverse effect on catalyst activity by the irreversible destruction of the zeolite crystalline structure to an amorphous lower activity material accompanied by pore plugging due to the migratory flow of low melting point vanadia produced and particularly encountered during catalyst regeneration at temperatures within the range of 704° C. (1300° F.) up to as high as 870° C. (1600° F.). The above identified copending applications establish the proprietary finding that the deactivating effects of vanadia can be suppressed substantially by reaction with titania. The addition of titania with the feed charged directly to the fluid catalyst cracking zone has been shown to immobilize vanadia and therefore depends on rapid reaction occurring in a riser cracking zone and before passing the catalyst to catalyst regeneration.

In order to void and minimize random contact between metal contaminants and the selective additive material herein identified to effect metals immobilization and alkaline material (Na) neutralization before contact with an active fluid cracking catalyst, the processing sequence of the present invention is pursued to improve the intimacy of contact and contact time of contaminants with the additive material prior to contact with catalyst to minimize potential random contact. In a particularly preferred embodiment, the select immobilization-neutralization metals are added all or in part to the desalted full boiling range crude oil before and/or during distillation thereof as above discussed so that contaminants normally concentrated in the higher boiling portions of the crude oil will be brought in relatively turbulent contact with the select additive material during pumping, heating, transfer through conduits between processing zones and intimacy of contact attributed by fractionation trays within the atmospheric distillation tower. Separation and recovery of agglomerated metal particles from one or more of the atmospheric distillation zones is contemplated as needed.

EXAMPLE I

A mixture comprising 2.5 g of sodium hydroxide; 47.5 g of water and 50 g of Tuzor (TPT-tetraisoprophyl titanate) was prepared and heated to about 38° C. (100° F.); which mixture provided 63.5 g of solid product. The solid product was analyzed and found to contain 3 wt% sodium and 97 wt% titanium. The product was identified as sodium titanate and titanium dioxide.

EXAMPLES II

A mixture comprising 10 g of vanadium naphthenate in 90 g of gas oil was mixed with 56. 3 g of Tyzor (TPT) and heated to a temperature of 93° C. (200° F.) which formed 10 g of a precipitate. The precipitate was analyzed and found to comprise 47 wt% vanadium and 1.8 wt% titanium. Some vanadium and titanium oxides were also found.

The above tests show that Tyzor (TPT-tetraisopropyl titanate) will neutralize alkaline material such as sodium and form reactive species with vanadium in reduced crudes. Thus, when the compounds of sodium titanate, vanadium titanate and titanium vanadate are formed and deposited on catalyst particles, a further need arises to determine what effect these compounds will have on a zeolite cracking catalyst activity and whether zeolite destruction at elevated temperatures is encountered in the riser hydrocarbon conversion zone and the catalyst regeneration operation in the presence of steam, air and air-steam mixtures of catalyst regeneration.

The following tests show that the compounds of sodium titanate and vanadium titanate have little effect if any on catalyst activity and that vanadium is effectively immobilized.

EXAMPLE III

The effect of sodium titanate ($Na_4TiO_4$) on a cracking catalyst was determined by the addition of 1 wt% thereof to an equilibrium crystalline zeolite containing cracking catalyst having a MAT activity of 65. The catalyst was steam at 787° C. (1450° F.) for 5 hours. After steaming the catalyst showed no significant decrease in MAT activity.

EXAMPLE IV

The effect of vanadium titanate ($V\text{-}TiO_4$) on a cracking catalyst was determined by adding 1.83 grams of vanadium titanate comprising 90% Ti and 10% vanadium to 150 grams of a zeolite containing cracking catalyst. The mixture was steam treated at 787° C. (1450° F.) and failed to significantly reduce the MAT activity below 65. It was determined that the catalyst surface area before treatment was 168 and 160 after treatment. The zeolite content was 9.1 wt% before and 9.0 wt% after treatment thereby further identifying the catalyst stability in the presence of formed vanadium titanate.

Having thus generally described the method and concepts of the invention and described specific examples in support thereof, it is to be understood that no undue restrictions are to be imposed by reasons thereof except as defined by the following claims.

What is claimed is:

1. A method for deactivating alkaline contaminants and metal contaminants in crude oils prior to affecting catalytic conversion of fractions thereof which comprises:

contacting a crude oil with one or more metal compounds selected from the group consisting of titanium, zirconium, and indium compounds immediately prior to or during distillation thereof, whereby residual alkaline material in said crude oil is neutralized and vanadium is reacted to form a reaction product having a melting point above the maximum temperature of a downstream catalytic conversion operation, and recovering a residual fraction of said crude oil boiling above 32.2° c. (630° F.) comprising metal contaminants reduced in deactivating affect upon a downstream contacted zeolite conversion catalyst at an elevated temperature.

2. A process according to claim 1 wherein said crude oil is desalted prior to said contact with one or more metal compounds, the desalting being accomplished by washing with sodium hydroxide and water to remove alkaline metal salts of sodium, magnesium, calcium, and potassium existing as chlorides, carbonates and/or sulfates in said crude oil and remove an acidic component such as hydrogen sulfide, phenolic acids and naphthenic acids thereby forming a washed crude oil.

3. The process of claim 1 wherein the residual alkali material comprises one or more elements of sodium, magnesium, calcium, potassium and compounds thereof.

4. The process of claim 1 wherein the metal contaminants comprise vanadium, nickel, iron and copper and wherein the oil is mixed with a select additive material so as to form high melting temperature mixture by the addition of an additive material selected from the group consisting of titanium, zirconium, indium, and compounds thereof.

5. A method according to claim 1 wherein said crude oil is contacted with a titanium compound.

6. A method according to claim 1 wherein said crude oil is contacted with a zirconium compound.

7. A method according to claim 1 wherein said crude oil is contacted with an indium compound.

8. The process of claim 1 wherein the select additive metal component is in an amount within the range of 0.01 up to about 2 wt% of the crude oil feed boiling above about 332° C. (630° F.)

9. The process of claim 1 wherein separation of a desalted crude oil feed is initially accomplished in a preflash zone and an atmospheric distillation zone with heating of the oil feed between zones and said select additive metal component is added all or in part to the crude oil feed either before or after said preflash zone and before said atmospheric distillation zone.

10. The process of claim 1 wherein said alkaline metal contaminants are present in said crude oils up to 50 ppms.

11. The process of claim 1 wherein said metals contaminants are present in said crude oils up to 50 ppm and has a Conradson Carbon value of 1 wt. % or more.

12. The process of claim 1 wherein said metal contaminants are present in said crude oils up to 100 ppm having a Conradson Carbon value of 2 wt. % or more.

13. The process of claim 1 wherein said metal contaminants are present in said crude oils up to 200 ppm having a Conradson Carbon value of 4 wt. % or more.

* * * * *